US006595090B1

(12) United States Patent
McQuillin

(10) Patent No.: US 6,595,090 B1
(45) Date of Patent: Jul. 22, 2003

(54) TOOL FOR MANUALLY TURNING AN ENGINE

(76) Inventor: Thomas McQuillin, 183 Paine Rd., Westmoreland, NH (US) 03467

( * ) Notice: Subject to any disclaimer, the term of this patent is extended or adjusted under 35 U.S.C. 154(b) by 0 days.

(21) Appl. No.: 10/055,543

(22) Filed: Jan. 22, 2002

(51) Int. Cl.[7] ..... B25B 33/00; F02N 1/00

(52) U.S. Cl. ..... 81/488; 123/179.26; 123/185.12

(58) Field of Search ..... 81/488; 123/179.27, 123/185.7, 179.25, 179.26, 185.11, 185.12, 185.1; 74/545, 550, 594.2

(56) References Cited

U.S. PATENT DOCUMENTS

| | | | | |
|---|---|---|---|---|
| 743,637 A | * | 11/1903 | Graham et al. | 123/185.1 |
| 2,804,957 A | * | 9/1957 | Pechin, Jr. | 123/179.26 |
| 4,157,083 A | | 6/1979 | Smith et al. | 123/179 P |
| 4,372,263 A | | 2/1983 | Costa | 123/179 SE |
| 4,615,311 A | | 10/1986 | Scheckel | 123/179 P |
| 5,329,896 A | | 7/1994 | Everts | 123/185.3 |
| 6,065,375 A | | 5/2000 | Leonard | 81/76 |
| 6,253,722 B1 | | 7/2001 | Robinson et al. | 123/179.24 |

* cited by examiner

*Primary Examiner*—D. S. Meislin
(74) *Attorney, Agent, or Firm*—Richard L. Miller

(57) ABSTRACT

A tool fixture for enabling a mechanic to manually rotate an internal combustion engine which comprises an assembly of components which is placed inside a starter motor housing. The assembled combination of the starter motor housing with the present invention is then attached to the engine's bell housing where the starter motor would normally reside. The gear teeth of the engine flywheel engages a gear fixedly mounted on a first end of a rotatable shaft of the present invention. A nut is fixedly mounted on a second end of the rotatable shaft which is accessible to a mechanic's wrench so that torque may appropriately be applied to the rotatable shaft which accordingly permits the fly wheel to be rotated slowly to any desired position as may be required so as to facilitate for the tuning and other adjustment procedures to be performed upon the engine.

3 Claims, 1 Drawing Sheet

TOOL FOR MANUALLY TURNING AN ENGINE

BACKGROUND OF THE INVENTION

1. Field of the Invention

The present invention relates to tool fixtures for facilitating manually turning an internal combustion engine.

2. Description of the Prior Art

Numerous innovations for cooperating with internal combustion engines have been provided in the prior art that will be described. Even though these innovations may be suitable for the specific individual purposes to which they address, accordingly they differ from the present invention.

A FIRST EXAMPLE, U.S. Pat. No. 4,157,083 to Smith et al. teaches disclosed heroin is a starter mechanism for an engine having a starter gear, which starter mechanism includes a rotatable starter a shaft, a starter pinion rotatably mounted on the starter shaft for axial movement, in response to rotation of the starter shaft in one direction, to an engine started position in driving engagement with the engine starter gear, and a drive member mounted for rotation coaxially with the starter shaft and drivingly connected to the starter shaft. Manual starting of the engine is selectively affected by rotating a circular member or rotor drivingly connected to the drive member through a first one-way clutch which, in response to rotation of the rotor in the one direction, affords common rotary movement of the rotor and the drive member and permits free wheeling of the drive member relative to the rotor in the same direction when the rotor is not operated. Powered starting of the engine is selectively effected, independently of the manual starter, by a power unit including a driven gear mounted coaxially with the drive member and drivingly connected to the drive member through a second one-way clutch which, in response to operation of the power unit, affords common rotary movement of the drive gear and the drive member in the one direction and which permits free wheeling of the drive member relative to the driven gear in the same direction when the power unit in not operated.

A SECOND EXAMPLE, U.S. Pat. No. 4,372,263 to Costa teaches a hand held electric motor driven drill is coupled by novel means to an internal combustion engine to start the engine. The end of the engine shaft is threaded to receive an elongated nut having a pair of V-shaped slot in its upper end, each slot having one side parallel to the axis of the shaft and the other side at an angle of 60 degrees to the first side. The chuck of the drill is fitted with a flat faced tool made from a conventional wood bit whose tip and cutting edges have been rounded off to provided a safe and secure coupling with the slots and hole in the end of the nut threaded onto the engine shaft. With the tool pressed into the slots in the nut, the drill motor is energized to rotate the tool. The flat faces of the tool bearing against the two side of the slots parallel to the axis of the shaft force the shaft to turn at the speed of the drill until the engine is started. The engine then picks up speed and as its speed exceeds that of the drill, the tool will be forced out of engagement with the nut by sliding along the 60 degree sloped side of the slots in the nut.

A THIRD EXAMPLE, U.S. Pat. No. 4,615,311 to Scheckel teaches a combined manual and power starting device for a gasoline engine which may be started by rotating the crankshaft thereof, the starting device consisting of a pair of rotary drive members operable respectively by manual and power devices, the manual device consisting of a pulley and a rope wrapped around the pulley to be pulled to turn the pulley in one direction to start the engine, so that the pulley cannot be turned by any device other than the rope without unwinding the rope therefrom, a power train connecting the power drive member to the crankshaft through a primary overrunning clutch, and a power train connecting the manual drive member to the crankshaft through the primary clutch, and also a secondary overrunning clutch, the secondary clutch being in series with the primary clutch but not in the power train from the power drive member to the crankshaft.

A FOURTH EXAMPLE, U.S. Pat. No. 5,329,896 to Everts teaches a replaceable starter assembly for a hand-held internal combustion engine of a power tool is disclosed. The replaceable starter assembly comprises a cartridge including a spool on which rope is wound and with a recoil spring for biasing the spool to rotate in one direction. The cartridge is secured to an engine housing of the power tool on the opposite side of the engine housing from the internal combustion engine. The cartridge may be detached from the engine housing of the power tool to facilitate the replacement of the starter assembly without requiring disassembly of the engine housing of the power tool. A starter housing substantially encloses the cartridge and is secured to the engine housing by removable fasteners. The starter housing may include a clutch and clutch drum which are removable with the starter housing and separable from the cartridge. The starter assembly is assembled to the power tool between the engine housing and a boom which supports the driveshaft of an implement.

A FIFTH EXAMPLE, U.S. Pat. No. 6,065,375 to Leonard teaches a hand tool for enabling a mechanic to manually rotate a diesel engine, said tool comprising an elongated generally L-shaped handle having a flange located at the lower end thereof and having toothed wheel secured to said handle at a point spaced from said flange a distance such that when said flange is inserted into the recess of a diesel engine damper, said toothed wheel will rest on the outer surface of said damper and, when said tool is rotated, said flange and said wheel will clamp said damper therebetween to enable the mechanic to manually rotate said damper and said engine.

A SIXTH EXAMPLE, U.S. Pat. No. 6,253,722 B1 to Robinson et al. teaches a starting device has a rotary drive member that is operable by hand or power devices. The device has a detented or geared strip arranged to engage with a similarly detented or geared starting wheel. The teeth of these parts are designed to grab and lock with each other in the starting direction and to slip past each other in the opposite direction. Crimping, sticking and other failure modes of conventional wind up rope units are virtually eliminated. A more consistent pull is afforded owing to a constant radius interface with the starter wheel rather than a diminishing radius of the type delivered by a wound rope.

SUMMARY OF THE INVENTION

AN OBJECT of the present invention is to provide a tool fixture for enabling a mechanic to manually rotate an internal combustion engine that avoids the disadvantages of the prior art.

ANOTHER OBJECT of the present invention is to provide a tool fixture for enabling a mechanic to manually rotate an internal combustion engine that is simple and inexpensive to manufacture.

STILL ANOTHER OBJECT of the present invention is to provide a tool fixture for enabling a mechanic to manually rotate an internal combustion engine that is staple to use.

BRIEFLY STATED, STILL YET ANOTHER OBJECT of the present invention is to provide a tool fixture for enabling a mechanic to manually rotate an internal combustion engine which comprises an assembly of components which is placed inside a starter motor housing and is held in the housing by two bolts. The assembled combination of the starter motor housing with the present invention is then attached to the engine's bell housing where the starter motor would normally reside. The gear teeth of the engine flywheel engages a gear fixedly mounted on a first end of a rotatable shaft of the present invention. A nut is fixedly mounted on a second end of the rotatable shaft which is accessible to a mechanic's wrench so that torque may appropriately be applied to the rotatable shaft which accordingly causes the fly wheel to be rotated slowly to any desired position as may be required so as to facilitate for the tuning and other adjustment procedures to be performed upon the engine.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures.of the drawings are briefly described as follows.

A MARSHALLING OF REFERENCE NUMERALS UTILIZED IN THE DRAWING

| | |
|---|---|
| 10 | engine |
| 12 | starter motor housing |
| 14 | present invention |
| 16 | suitable wrench |
| 18 | nut element |
| 20 | rotatable shaft |
| 22 | two machine bolts |
| 24 | circular shaped mounting plate |
| 26 | force as indicated by arrow |
| 28 | pinion gear |
| 30 | stub portion of the shaft 20 |
| 32 | teeth of the pinion gear 28 |
| 34 | bearing |
| 36 | orifice located concentrically within circular mounting plate 24 |
| 38 | two bolt holes |
| 40 | collar is integrally formed with pinion gear 28 |
| 42 | weld bead |
| 44 | washer |
| 46 | pin |
| 48 | helical compression spring |
| 50 | axial direction indicated by arrow |
| 52 | hole which transverse the shaft 20 |

DETAILED DESCRIPTION OF THE PREFERRED EMBODIMENT

Figure 1:
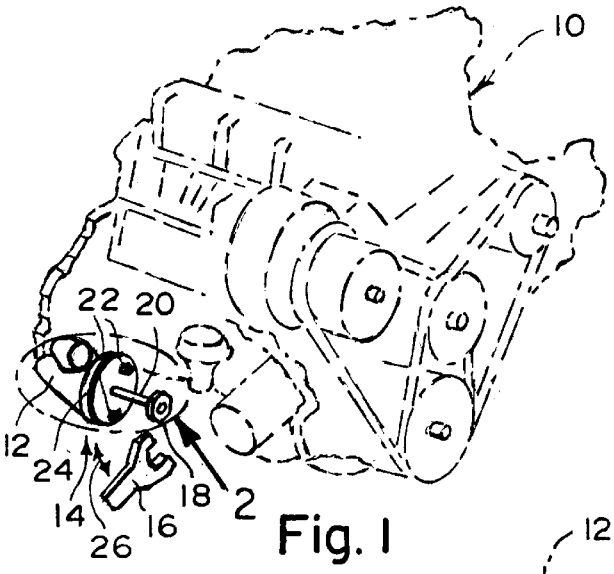
FIG. 1 is a diagrammatic perspective view of an internal combustion engine shown in phantom and showing the location where the present invention would be secured to the engine enclosed in the dotted curve indicated by arrow 2.
Figure 4:
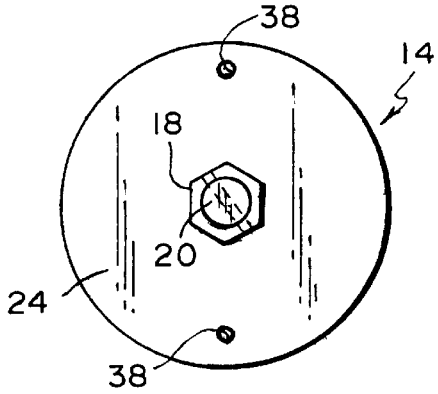
FIG. 4 is an end elevational view taken from a second end of a rotatable abaft in the direction of arrow 4 in FIG. 2.

Referring now to the figures, in which like numerals indicate like parts, and particularly to FIG. 1, is seen an engine 10 shown in phantom having a starter motor housing 12 mounted thereon with the present invention 14 installed therein. A suitable wrench 16 is shown in close proximity which may be fitted upon a nut element 18 fixedly secured to a rotatable shaft 20, so that a mechanic may accordingly apply force as indicated by arrow 26, producing a torque which in turn causes the engine to rotate.

Figure 2:
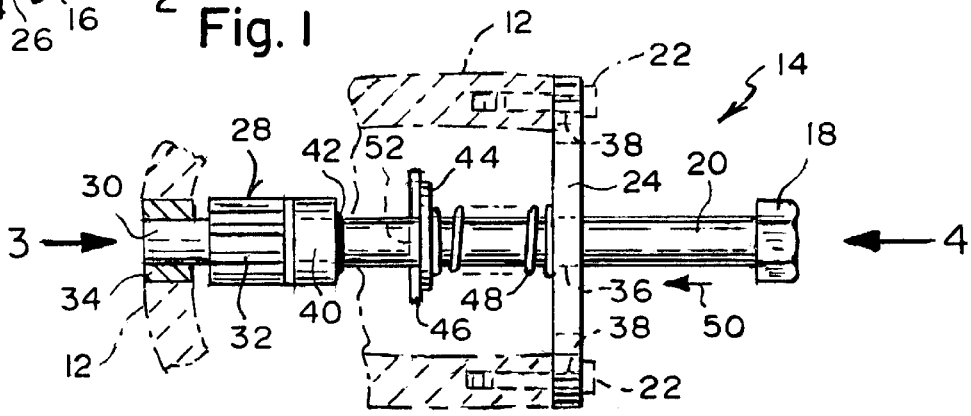
FIG. 2 is an enlarged diagrammatic side elevational view of the present invention enclosed in the dotted curve indicated by arrow 2 in FIG. 1.
Figure 3:
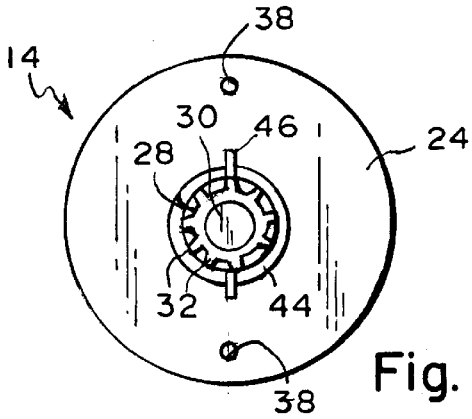
FIG. 3 is an end elevational view taken from a first end of a rotatable abaft in the direction of arrow 3 in FIG. 2.

As better seen in greater detail in FIG. 2. passed through two bolt holes 38, are two machine bolts 22, which are utilized to secure a circular shaped mounting plate 24 to the starter motor housing 12, by virtue of the fact that they are threaded into two corresponding tapped threaded holes in the starter motor housing 12. A pinion gear 28 is fixedly attached to a first end of the rotatable shaft 20 while the nut element 18 is fixedly secured to a second end of the rotatable shaft 20. A stub portion 30 of the shaft 20 protrudes past the teeth 32 of the pinion gear 28 which is accordingly Journalled in a bearing 34 of the starter motor housing 12. A collar 40 is integrally formed with pinion gear 28 and is utilized for fixedly securing the gear by welding the collar with weld bead 42 to the rotatable shaft 29. The rotatable shaft 20 is additionally Journalled in an orifice 36 located concentrically within the circular mounting plate 24.

A washer 44 is trapped on the rotatable shaft 20, between a pin 46 and a helical compression spring 48. The helical compression spring 48 biases the shaft 20 in an axial direction indicated by arrow 50 with respect to the circular mounting plate 24 so that the device can be accommodated by a range of starter motor housings 12 which vary in length from one another. The pin 46 is force fitted in a hole 52 which transverses the shaft 20 and prevents the washer 44 from sliding there past so that the helical compression spring 48 can accordingly transfer biasing force to the shaft 20.

It will be understood that each of the elements described above, or two or more together, may also find a useful application in other types of constructions differing from the types described above.

While the invention has been illustrated and described as embodiments of a tool fixture for enabling a mechanic to manually rotate an internal combustion engine, accordingly it is not limited to the details shown, since it will be understood that various omissions, modifications substitutions and changes in the forms and details of the device illustrated and its operation can be made by those skilled in the art without departing in any way from the spirit of the present invention.

Without further, analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A tool fixture for enabling a mechanic to manually rotate an internal combustion engine which comprises:

a) a rotatable shaft for transmitting torque to a fly wheel of said internal combustion engine;

b) a pinion gear fixedly attached to a first end of said rotatable shaft for engaging with teeth of a fly wheel of said internal combustion engine; and c) a nut fixedly mounted on a second end of said rotatable shaft which is accessible to a mechanic's wrench so that torque may appropriately be applied to said rotatable shaft which accordingly permits the fly wheel to be rotated slowly to any desired position as may be required so as to facilitate tuning and other adjustment procedures to be performed upon said internal combustion engine, wherein said rotatable shaft has a stub portion which protrudes east a tooth portion of said pinion gear for journalling in a bearing of a housing of a starter motor, wherein said rotatable shaft has a portion additionally journalled in a mounting plate, wherein said mounting plate is circularly shaped, wherein said mounting plate has at least two bolt holes for facilitating securing to said starter motor housing.

2. The tool as defined in claim 1, wherein said pinion gear is fixedly attached to a first end of said rotatable shaft by a welding bead.

3. The tool as defined in claim 1, wherein a washer is trapped on said rotatable shaft, between a pin and a helical compression spring which biases said rotatable shaft in an axial direction, so as to accommodate a range of starter motor housings having various lengths.

* * * * *